US006394707B1

(12) United States Patent
Kennedy et al.

(10) Patent No.: US 6,394,707 B1
(45) Date of Patent: May 28, 2002

(54) YIELDABLE MINE ROOF SUPPORT

(75) Inventors: William R. Kennedy; John M. Kennedy, both of Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 0 days.

(21) Appl. No.: 08/853,309

(22) Filed: May 8, 1997

(51) Int. Cl.[7] ..... E21D 15/14

(52) U.S. Cl. ..... 405/288; 405/289; 405/290; 248/354.2

(58) Field of Search ..... 405/288, 289, 405/303, 290; 248/351, 354.2, 354.1

(56) References Cited

U.S. PATENT DOCUMENTS

| | | | | | |
|---|---|---|---|---|---|
| 881,609 | A | * | 3/1908 | Nellen et al. | 405/288 |
| 4,131,480 | A | | 12/1978 | McCurrich et al. | 106/93 |
| 4,185,940 | A | | 1/1980 | Spies | 405/288 |
| 4,277,204 | A | * | 7/1981 | Koppers et al. | 405/288 |
| 4,316,505 | A | | 2/1982 | Lammiman et al. | 166/293 |
| 4,332,512 | A | | 6/1982 | Heintzmann et al. | 405/290 |
| 4,481,039 | A | | 11/1984 | Mendenhall | 106/281 R |
| 4,528,792 | A | | 7/1985 | Cross et al. | 52/704 |
| 4,712,947 | A | * | 12/1987 | Thom | 405/288 |
| 4,802,922 | A | | 2/1989 | Smart | 106/89 |
| 4,875,937 | A | | 10/1989 | Viles | 106/104 |
| 4,992,103 | A | | 2/1991 | Smart | 106/695 |
| 5,015,125 | A | * | 5/1991 | Sfegmillar | 405/288 |
| 5,096,497 | A | | 3/1992 | Beale et al. | 106/692 |
| 5,141,365 | A | | 8/1992 | Smart | 405/267 |
| 5,143,340 | A | | 9/1992 | Wood et al. | 248/354.2 |
| 5,165,824 | A | | 11/1992 | Corcoran et al. | 405/288 |
| 5,165,958 | A | | 11/1992 | Plaisted et al. | 427/136 |
| 5,167,474 | A | | 12/1992 | Kennedy et al. | 405/132 |
| 5,273,378 | A | | 12/1993 | Merz et al. | 405/290 |
| 5,308,196 | A | | 5/1994 | Frederick | 405/288 |
| 5,320,424 | A | | 6/1994 | Annett et al. | 366/8 |

FOREIGN PATENT DOCUMENTS

| | | |
|---|---|---|
| AU | A-7592/91 | 1/1992 |
| DE | 28 10 365 A1 | 9/1979 |
| EP | 0 040 096 A1 | 11/1981 |
| GB | 1 415 822 | 2/1976 |
| GB | 1 547 407 | 6/1979 |
| GB | 1 588 130 | 4/1981 |
| GB | 2 070 666 A | 9/1981 |
| GB | 2 100 318 A | 12/1982 |
| GB | 2 207 365 | 2/1989 |
| GB | 9826808.9 | 1/1999 |

* cited by examiner

*Primary Examiner*—Heather Shackelford
*Assistant Examiner*—Frederick L. Lagman
(74) *Attorney, Agent, or Firm*—Senniger, Powers, Leavitt & Roedel

(57) ABSTRACT

A mine roof support designed to extend vertically in a mine passageway. The support includes a containment structure having at least two telescoping containment members freely telescopically movable relative to one another, and a filler material introducible into the containment structure to form a column of material extending vertically in the passageway. Each containment member defines an interior space for receiving the filler material. The material is hardenable inside the containment structure to form a yieldable column whereby in the event of a mine convergence, the yieldable material yields while providing continued support and the telescoping containment members move freely relative to one another to permit such yielding without damage to the containment structure. A method of installing such a roof support is also disclosed.

17 Claims, 1 Drawing Sheet

YIELDABLE MINE ROOF SUPPORT

BACKGROUND OF THE INVENTION

This invention relates generally to mine roof supports, and more particularly to the installation of a yieldable mine roof support.

Mine roof supports are often required in active mines to prevent arching of the roof over time and possible collapsing of the roof. Roof supports may also be used in areas of a mine no longer being worked. The support is typically made of wood columns or cribs, or cast-in-place concrete members. However, these constructions have certain drawbacks. For example, supports constructed of precast concrete members have inherent lines of weakness between the members, thereby decreasing the overall strength of the support. While a poured concrete support overcomes this problem, special forms for the concrete must be fabricated, resulting in high installation costs. Furthermore, these supports do not allow for settling or convergence of the mine roof relative to the mine floor. It is important that the mine roof support be made from a yieldable material so that in the event of such settling or convergence, the support will yield and continue to support the roof without exhibiting failure. Other types of devices made of wood or other materials that allow for displacement between the roof and the floor commonly exhibit columnar or shear failure of the support.

There is a need therefore, for a more cost effective and efficient way to construct a permanent mine support that will last over an extended period of time.

SUMMARY OF THE INVENTION

Among the several objects of this invention may be noted the provision of a mine roof support formed from a yieldable material to permit yielding during a mine convergence, for example, while continuing to provide support to the mine roof; the provision of such a support which is highly resistant to columnar shear failure; the provision of such a support which is quick and easy to erect and which is readily adaptable to fit passageways of different heights and widths; the provision of such a support which is economical to manufacture; the provision of such a support which occupies minimal space within the mine and minimizes restriction of travel within the mine; and the provision of such a support which is durable to support a mine roof over a period of time.

A mine roof support of this invention is adapted to extend vertically in a mine passageway. In general, the mine roof support includes a containment structure having at least two telescoping containment members freely telescopically movable relative to one another and a filler material introducible into the containment structure to form a column of material extending vertically in the passageway. Each containment member defines an interior space for receiving the filler material. The material is hardenable inside the containment structure to form a yieldable column whereby in the event of a mine convergence the yieldable material yields while providing continued support and the telescoping containment members move freely relative to one another to permit such yielding without damage to the containment structure.

A method of installing a roof support of this invention in a mine passageway generally includes the steps of pumping a fluid, hardenable material into the telescoping containment members to cause the upper containment member to telescopically rise with respect to the lower containment member to form a column of material inside the containment structure, allowing the hardenable material to form a yieldable set inside the containment structure, and leaving the telescoping containment structure with the hardened material therein permanently in place while allowing for freedom of movement between the telescoping parts of the containment structure so that in the event of a mine convergence the yieldable material yields while providing continued support and the telescoping containment members of the containment structure move freely relative to one another to permit such yielding without damage to the containment structure.

Other objects and features will be in part apparent and in part pointed out hereinafter.

BRIEF DESCRIPTION OF THE DRAWINGS

Corresponding reference numerals designate corresponding parts throughout the several views of the drawings.

DESCRIPTION OF THE PREFERRED EMBODIMENT

Figure 1:
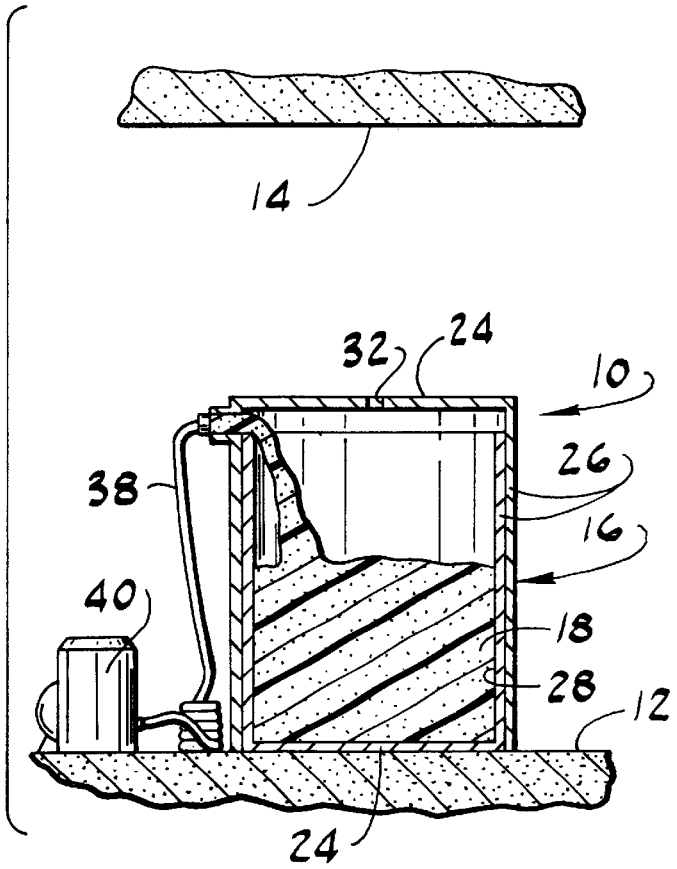
FIG. 1 is an elevation of a mine roof support of this invention in its collapsed position.

Referring now to the drawings, and first to FIG. 1, there is generally indicated at 10 a mine roof support of this invention. The support is adapted to extend vertically in a mine passageway between a floor 12 and a roof 14 of the passageway. The support is shown in a fully collapsed position in FIG. 1 and in an extended, roof-supporting position in FIG. 2. The support includes a containment structure, generally designated 16, and a yieldable filler material 18 introducible (e.g., pumpable) into the containment structure to form a column of material extending vertically in the passageway. In the event of a mine convergence the yieldable material 18 yields while providing continued support. As described below, the containment structure 16 is designed to yield without damage to the containment structure.

Figure 2:
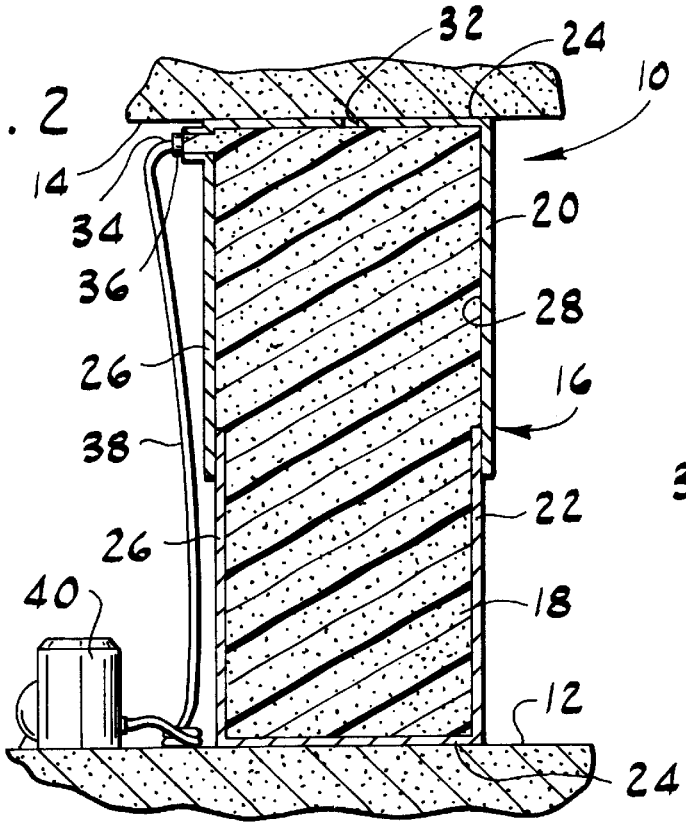
FIG. 2 is an elevation of the support of FIG. 1 in its extended (roof-supporting) position.
Figure 3:
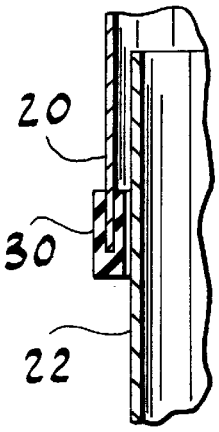
FIG. 3 is an enlarged cross-sectional view showing a sealing configuration between telescoping containment members of the support of FIG. 1.

In the particular embodiment shown in the drawings, the containment structure comprises two telescoping containment members 20, 22 freely telescopically movable relative to one another, the upper telescoping member being designated 20 and the lower telescoping member being designated 22. The containment members 20, 22 have a telescoping sliding fit with one another to permit adjustable extension of the support according to the height of the passageway and to allow for movement of the members as the mine roof 14 settles over time. The upper and lower containment members 20, 22 have end walls 24 and cylindrical side walls 25 which combine to form a cavity 28 for receiving the filler material. As illustrated in FIGS. 1–3, the lower containment member 22 has a diameter slightly smaller than the upper containment member 20 for sliding of the lower containment member within the upper containment member, but it is to be understood that the containment structure could also be configured such that the lower containment member has a diameter larger than the upper containment member. The cross sectional shape of the containment members could also be other than circular (e.g., rectangular).

The containment members 20, 22 are sized to have as small a diameter as possible to reduce manufacturing, transportation and installation costs and to minimize blockage of the mine passageway, while still providing sufficient strength to support the anticipated load of the roof without buckling or failure due to stress. The specific size requirements are determined by the strength of the filler material, the load to be imposed on the support, the height of the support, and other mechanical and structural considerations known to those skilled in this field. The overall diameter of the support preferably ranges from about 6 in. to about 8 feet. Even more preferably, the outer diameter of the upper containment member 20 is between 2.5 feet and 3.5 feet and may be 3 feet–0.125 inches, for example. The diameter of the lower containment member 22 is preferably between 2.4 feet and 3.4 feet and may be 2 feet–11.875 inches, for example. The clearance between the side walls 26 of the upper and lower containment members is preferably between 0.0625 and 0.25 inches, but this number may vary. The thickness of the walls 26 of the containment members may be, for example, 0.070 to 0.087 inches and are preferably sized to sustain at least 150 psi of pressure. The height of the side walls 26 of the containment members 20, 22 may vary depending-on the height of the mine roof 14 to be supported. The containment members 20, 22 are sized to allow for some overlap of the side walls 26 of each containment member when the containment structure 16 is in its extended (roof-supporting) position. The containment members 20, 22 may be formed from 20 gage galvanized steel or any other suitable material such as a polymeric material. It is to be understood that the number of containment members 20, 22, the diameters of the containment members, the wall thickness of the members and the clearances between the members may vary without departing from the scope of this invention. The side walls of the containment members may also be fabricated as single-thickness walls or formed from multiple layers of material. Alternatively, for added strength, the support may comprise an inner set of telescoping containment members inside an outer set of telescoping members.

Referring to FIG. 3, an annular seal 30 is provided between the overlapping side, walls to prevent leakage of filler material 18 from between the sliding interface of the containment members 20, 22. The seal 30 could be on either containment member, but it is shown in FIG. 3 as being located around the circumference of the upper end of the lower containment member 22 and sealing against the inside wall of the upper containment member 20. Sealing rings of various cross sectional shapes may be used to obtain adequate sealing between the containment members 20, 22. It is also possible to reduce the clearances between the side walls 26 of the containment members 20, 22 to eliminate the need for a seal 30. The viscosity of the filler material 18 allows for elimination of the seal 30 at the interface of the containment members 20, 22 without excessive leakage of the filler material 18 prior to the material hardening.

The end wall 24 of the upper containment member 20 has an opening 32 for venting air from the cavity 28 during filling. of the structure with filler material 18. The vent 32 allows air within the containment structure 16 to be forced out of the structure as the filler material 18 is pumped into the structure to allow the entire cavity 28 to be filled with the filler material. Once the filler material 18 reaches the vent 32 and the air has been forced out of the containment structure 16, the vent will be occluded with filler material which will eventually harden.

The upper containment member 20 further includes an inlet port 34 for filling the containment structure 16 with the filler material 18. The inlet port 34 is sized to allow adequate flow into the containment structure 16 to allow for quick installation of the support 10. The port 34 may include a quick disconnect fitting 36 for connecting a hose 38 to the inlet port. The inlet port is preferably located on the side wall 26 of the upper-containment member 20 adjacent to the end wall 24 of the member. The height of the lower containment member 22 is slightly less than the height of the upper containment member 20 to prevent blockage of the inlet port 34 when the containment structure is in its fully collapsed position.

The filler material 18 is preferably (but not necessarily) a foamed cement material which is generally made from cement entrained with air or other gas. The material 18 is pumpable into the cavity of the containment structure and hardenable after a relatively short period of time. Alternatively, the filler material could be a spongy liquid. When hardened the material forms a very weak porous concrete entrained with air having a compressive strength preferably in the range of approximately 100 psi to 400 psi, although this number can vary considerably. The foamed cement material 18 may be of the type available from Alminco of Lexington, Ky., sold under the trade name FOAMED CEMENT, or from Fosroc/Celtite, Inc. of Georgetown, Ky., sold under the trade name TECHSEAL. It is to be understood that other suitable hardenable, yieldable materials may be used as long as the material has suitable compression and strength characteristics to support the weight of a mine roof 14 and yet still yield to allow for movement of the roof over time. The yield rate of the material 18 selected is based on the strength of the material of the containment members 20, .22 and diameter of the containment members. The selection of material 18 for proper yield rate is important because if the material yields too easily the support will not adequately support the roof and if the material is too stiff, the support may fail from excessive internal stress or overload the mine roof 14 or floor 12.

Filler material 18 is pumped into the cavity 28 of the containment structure 16 by means of a pump 40 (sometimes referred to as a "concrete" or "grout" pump) connected to the inlet port 34 via a hose 38. The length of hose 38 required varies depending on the type of pump 40 used and the specific material used. (Suitable pumps and associated equipment are typically provided by the suppliers of the filler material used.) Additional length of hosing 38 may be required to allow the foamed cement to absorb the proper amount of air and develop the correct consistency. The operating pressure and flow rate of the pump 40 is determined by the volumetric coefficient of the pump and the frictional losses in the hose 38. A pressure as low as 1 psi may be sufficient to force the cylinder to extend. However, it is preferable to use higher pressures (e.g., 100–150 psi) to force a sagging mine roof 14 up against more solid strata located above the lower surface to prevent additional disintegration of the roof.

A method for installing the roof support 10 in the mine passageway includes the steps of pumping a fluid, hardenable material 18 of the type described above, into the telescoping containment members to cause the upper containment member 20 to telescopically rise with respect to the lower containment member 22, venting air from the containment structure 16 while pumping the material into the structure, allowing the hardenable material to form a yieldable set inside the containment structure, and leaving the telescoping containment structure with the hardened material therein permanently in place while allowing for freedom of movement between the telescoping parts of the containment structure so that in the event of a mine convergence the yieldable material yields while providing continued support and the telescoping containment. members of the containment structure move freely relative to one another to permit such yielding without damage to the containment structure.

To use the mine roof support 10 in accordance with the method of this invention, the containment structure 16 is placed on the floor 12 of the mine in its collapsed position. The hose 38 is connected to the inlet port 34 and the filler material 18 is pumped into the cavity 28 of the containment structure 16. As the filler material 18 is pumped into the containment structure 16, air is vented from the containment structure 16 through the vent 32 and the upper containment member 20 telescopically rises with respect to the lower containment member until the end wall 24 of the member engages the roof 14 of the mine. The pump 40 may force additional filler material 18 into the containment structure 16 after engagement of the upper containment member 20 with the mine roof 14 to ensure that there is sufficient contact between the upper containment member and the roof to provide adequate support of the roof. After the filling of the containment structure 16 is complete, the hose 38 is removed from the inlet port 34 and the filler material 18 is left to fully harden. The support 10 is then left in place for as long as the mine is kept open or as long as required. The design of the structure allows for freedom of movement between the telescoping parts 20, 22 so that in the event of a mine convergence the yieldable material yields while providing continued support and the telescoping containment members move freely relative to one another to permit such yielding without damage to the containment structure. The finished support 10 provides a large load carrying capacity while maintaining a yieldability sufficient to provide continuing support of the mine roof 14 even after yielding a substantial portion of its initial height to reduce the risk of a catastrophic failure. The steel containment members also prevent columnar shear failure of the support.

In view of the above, it will be seen that the several objects of the invention are achieved and other advantageous results attained.

As various changes could be made in the above methods and constructions without departing from the scope of the invention, it is intended that all matter contained in the above description or shown in the accompanying drawings shall be interpreted as illustrative and not in a limiting sense.

What is claimed is:

1. A mine roof support adapted to extend vertically in a mine passageway, said support comprising a containment structure having at least two tubular telescoping containment members freely telescopically movable relative to one another and defining an interior space inside said containment members, and a yieldable filler material substantially filling said interior space to form a yieldable column of material extending vertically in the passageway, said column being capable of yielding while providing continued support and the telescoping containment members being capable of moving freely relative to one another to permit such yielding without damage to the roof support.

2. A mine roof support as set forth in claim 1 comprising two telescoping containment members, each containment member comprising an end wall and a side wall extending therefrom.

3. A mine roof support as set forth in claim 2 wherein one containment member has a diameter slightly smaller than the other containment member for sliding of the one containment member within the other containment member.

4. A mine roof support as set forth in claim 3 wherein the side walls of the containment member overlap, said containment structure further comprising a seal located between the overlapping side walls.

5. A mine roof support as set forth in claim 4 wherein one containment member has a diameter in the range of about 2.5 feet to 3.5 feet and the other containment member has a diameter in the range of about 2.4 feet to 3.4 feet.

6. A mine roof support as set forth in claim 2 further comprising an opening in the end wall of one containment member for venting air from the containment structure.

7. A mine roof support as set forth in claim 2 wherein one telescoping containment member has an inlet port for filling the containment structure with said filler material.

8. A mine roof support as set forth in claim 7 wherein said inlet port is in the side wall adjacent to the end wall.

9. A mine roof support as set forth in claim 1 wherein said filler material comprises a foamed cement material.

10. A mine roof support as set forth in claim 1 wherein said telescoping containment members are formed from steel.

11. A mine roof support as set forth in claim 1 wherein the yieldable filler material completely fills the interior space.

12. A method of installing a roof support in a mine passageway, said support comprising an upper telescoping containment member and a lower telescoping containment member freely telescopically movable relative to one another and a filler material pumpable into the containment members to form a yieldable column of material extending vertically in the passageway, the containment members defining an interior space for receiving said filler material, said method comprising the steps of:

pumping a fluid, hardenable material into the telescoping containment members to cause the upper containment member to telescopically rise with respect to the lower containment member to form a column of material inside the containment members, allowing the hardenable material to form a yieldable set inside the containment members, and leaving the telescoping containment members with the hardened material therein permanently in place while allowing for freedom of movement between the telescoping members so that the yieldable material is capable of yielding while providing continued support and the telescoping containment members are capable of moving freely relative to one another to permit such yielding without damage to the support.

13. A method as set forth in claim 12 further comprising the step of venting air from the containment structure while pumping the hardenable material into the containment structure.

14. A method as set forth in claim 12 wherein the step of pumping said hardenable material into the containment structure includes pumping the material at a pressure of between 1 and 150 psi.

15. A method a set forth in claim 12 wherein the step of pumping said hardenable material includes pumping cement material entrained with air into the containment members.

16. A method as set forth in claim 12 wherein the step of pumping the fluid, hardenable material into the containment members causes the upper containment member to contact the mine roof and forms a column of material completely filling the interior space.

17. A mine roof support adapted to extend vertically in a mine passageway, said support comprising a containment structure having at least two tubular telescoping containment members freely telescopically movable relative to one another and defining an interior space inside said containment members, a yieldable cementitious material substantially filling said interior space to form a yieldable column of material extending vertically in the passageway, one of said containment members having an inlet port for filling the interior space with said cementitious material, said column being capable of yielding while providing continued support and the telescoping containment members being capable of moving freely relative to one another to permit such yielding without damage to the support.

* * * * *